United States Patent [19]

Ubukata et al.

[11] Patent Number: 4,551,701

[45] Date of Patent: Nov. 5, 1985

[54] THERMALLY ACTUATED SWITCHING DEVICE

[75] Inventors: Susumu Ubukata, 549-banchi, Nakasuna-cho, Tempaku-ku, Nagoya, Japan; Yasukazu Mizutani, Nagoya, Japan

[73] Assignee: Susumu Ubukata, Japan

[21] Appl. No.: 611,177

[22] Filed: May 17, 1984

[51] Int. Cl.[4] ..... H01H 61/00; H01H 71/16

[52] U.S. Cl. ..... 337/97; 337/89; 200/144 R

[58] Field of Search ..... 337/97, 89; 200/144 R

[56] References Cited

U.S. PATENT DOCUMENTS

| | | | |
|---|---|---|---|
| 2,498,039 | 2/1950 | Gunn | 337/97 |
| 2,870,294 | 1/1959 | Vander Ply et al. | 337/97 |
| 3,902,149 | 8/1975 | Senor | 337/97 |
| 4,287,499 | 9/1981 | Pejouhy | 337/97 |

*Primary Examiner*—Harold Broome

*Attorney, Agent, or Firm*—Steele, Gould & Fried

[57] ABSTRACT

A thermally actuated switching device is disclosed that comprises a fixed contact placed on a proper member, a thermally actuated member such as a bimetallic member in the center of which is formed of a thin dish shape which contributes to a snap-action caused by heating of the bimetallic member, a bracket keeping the thermally actuated member in the concave-formed condition, a movable contact, which contacts on or removes from the fixed contact and is secured on the free end of the thermally actuated member, and a heat-resistant arc shield cantileverly held on the free end of the thermally actuated member or on a proper supporting member against the movable contact mounted surface of the thermally actuated member, so that the arc shield protects the thermally actuated member from an arc being introduced to it and prevents the deviation of the operation temperature of the thermally actuated member at the open or close action.

5 Claims, 6 Drawing Figures

THERMALLY ACTUATED SWITCHING DEVICE

FIELD OF THE INVENTION

This invention relates to thermally actuated switching devices that comprise a thermally actuated member such as bimetallic or trimetallic member, having a movable contact secured on its free end contacting to and removing from a corresponding fixed contact, cantileverly held from a stationary member or supported on or around its center, and especially relates to devices having a thermally actuated member in the center of which is formed a thin dish shape for the snap-action caused by the temperature change of the thermally actuated member.

DESCRIPTION OF THE PRIOR ART

Various known thermally actuated switching devices comprise a thermally actuated member such as bimetallic or trimetallic member, having a movable contact secured on its free end contacting to and removing from a corresponding fixed contact, contileverly held from a stationary member or supported around its center, and especially relates to devices having a thermally actuated member the center of which is formed of a thin dish shape for the snap-action caused by the temperature change of the thermally actuated member.

In these switching devices, because the thermally actuated member is laminated by selectively provided thin metals having different coefficience of thermal expansion for causing a quick snap-action, when the thermally actuated member is exposed to high temperature arc, the elasticity of the metallic member varies and the formation of the metallic member is distorted, which changes the thrust generated from the thin dish portion. This results in the snap-action occurring at a different temperature from a predetermined temperature.

Furthermore, in practice, it is often determined first for essential elements or dimensions to be subject to the switching performance, such as the specific resistance, deflection constant, and other physical dimensions of the metallic member making up of the thermally actuated member, accordingly, the consideration of heat-resistance on the member is not so easy.

There has still been no prior device that sufficiently solve the above problem. Therefore, the present invention provides a device to prevent such condition that the thermally actuated member is exposed directly to radiating heat, or arcing produced between contacts.

OBJECT OF THE INVENTION

It is an object of the present invention to provide an improved thermally actuated switching device for limiting the deviation of the operation temperature from a predetermined temperature, increasing the number of on-off switching operation cycles, by arc produced between the movable contact mounted at the free end of the thermally actuated member and the fixed contact mounted on a proper supporting member when the movable contact removes from the fixed contact.

It is another object of the present invention to provide a thermally actuated switching device having a member arrangement without an increase in the total size of the device providing protection of the thermally actuated member from arc produced between the contacts.

It further object of the present invention to provide a thermally actuated switching device having a special arrangement in relation to the relative placement for both the movable contact and the fixed contact so as to suppress the arc generated between the fixed contact and movable contact induced into a direction of the thermally actuated member.

SUMMARY OF THE INVENTION

This invention relates to a thermally actuated switching device that comprises a fixed contact placed on a proper member, a thermally actuated member such as a bimetallic member in the center of which is formed of a thin dish shape so as to contribute to a snap-action of the bimetallic member, a bracket keeping the thermally actuated member in the concave-formed condition, a movable contact, which contacts on or removes from the fixed contact secured on the free end of the thermally actuated member, and an arc shield made of a heat-resistant material that is so placed that the arc shield separates the space between the bimetallic member and the contacts. The arc shield prevents the thermally actuated member from being directly exposed to the radiation heat of arc generated between the movable contact and fixed contact, therefore, gradual variation of the opening temperature and closing temperature of the thermally actuated member by arc radiation heat can be suppressed, and consequently the durability of the switch becomes long.

Because the arc shield is essentially allowed to form a plate and is located adjacently to and along the thermally actuated member, the total volume of the switching device is not increased; a compact switching device can be provided.

The switching device of this invention, in addition to the above location of the arc shield, has a special arrangement of a fixed contact and movable contact. These contacts are arranged that the center of the fixed contact is deviated by a required degree from the center of the movable contact toward the opposite direction of the center of the thermally actuated member with a proper relatively inclining angle at the crossing of each contact center line.

The above contact arrangement has an advantage of minimizing the generating arc and the removal of arc from the thermally actuated member, therefore, it is effective for the reduction of the thermal influence on the thermally actuated member from arc.

Other objects and advantages of this invention will become apparent from the following description when it is considered in conjunction with the appended claimes and the acccompanying drawings.

DETAILED DESCRIPTION

Figure 1:
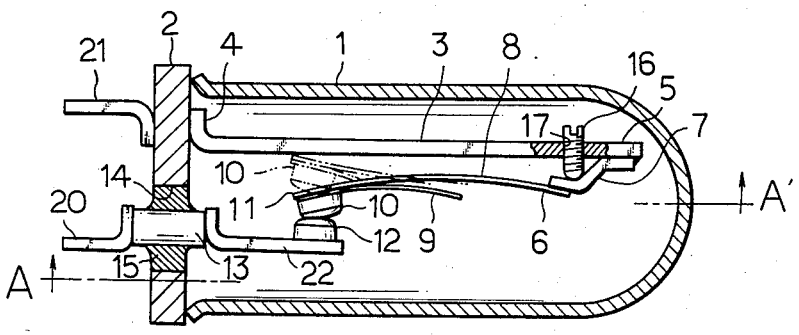
FIG. 1 is a cross sectional view with a dotted lined partial section of a thermally actuated switching device of the present invention.
Figure 2:
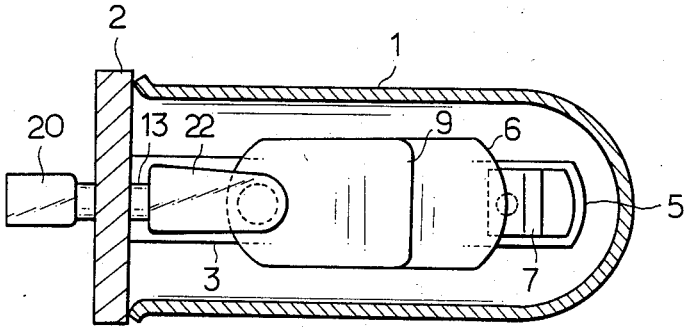
FIG. 2 is a bottom view taken on the line A—A′ of FIG. 1.

Referring first to the embodiment of the invention in FIG. 1 and FIG. 2, the switching device comprises a metallic housing 1 secured to a metallic base 2. Mounted in the housing 1 is a metallic supporting member 3, one end 4 of which is secured on the metallic base 2. On the other end 5 of the supporting member 3 is connected a bimetallic member 6, which belong in the thermally sensing element including the trimetallic member, deformed with temperature change, is resiliently secured through a metallic crank-shaped bracket 7. A thin dish shape 8 around the center of the thermally actuated member 6 contributes to the snap-action at the turning of the bimetallic member 6.

The rectangular-shaped arc shield 9 is made of heat-resistance material with the dimension of the width nearly the same as that of the bimetallic member 6. The shield preferably extends approximate $\frac{2}{3}$ of the length of the bimetallic member 6 toward the opposite direction from the movable contact 10. One end of the shield 9 is secured on the free end 11 of the bimetallic member 6 together with the movable contact 10. Accordingly, the arc shield 9 can cover enough arcing area to inhibit the arc from contacting the bimetallic member 6 and/or other members. Because the arc shield 9 is secured together with the movable contact 10, there is no interference with the thermal actuation of the bimetallic member 6.

A fixed contact 12 corresponding to the movable contact 10 is joined with a metallic pin 13 through hole 14 in the metallic base 2 which is filled with an electrical insulator 15, such as glass resins, etc.

An adjusting screw 16 engaged in the threaded hole 17 adjacent to the free end 5 of the supporting member 3 applies a thrust on the bracket 7 and on the bimetallic member 6 to vary the concave formation of the bimetallic member 6 to make the free end 11 of the bimetallic member 6 go downward. Subsequently, a pressure is provided between the movable contact 10 and the fixed contact 12 in the ON position.

The lead pin 20 is secured on the pin 13 and another lead pin 21 is secured on the base 2 to lead electricity into the switching device.

When the bimetallic member 6 is heated up to a predetermined temperature, for instance 170° C., for example to an electric current from an excessively loaded motor that passes between the lead pins 20 and 21 via the bimetallic member 6, a thrust caused from the thin dish portion 8 is exerted upon the whole length of the bimetallic member 6 to open it with a snap-action to the OFF position shown as the dotted line in FIG. 1.

An arc is generated between the movable contact 10 and the fixed contact 12 when the contact 10 quickly moves apart from the contact 12 during a high current flow there. The arcing may damage surrounding members, especially the bimetallic member 6, as well as the surfaces of the contacts 10 and 12 by its heat unless the arc shield 9 is installed. When the bimetallic member 6 is exposed to such arcing, the member 6 is heated, resulting in the opening and closing temperatures of the member 6 deviating from the predetermined temperature. It is difficult for the bimetallic member 6 to be processed to have heat resistance in order to avoid such temperature deviation.

In an experiment, in a switching device without the arc shield 9 of FIG. 1-type, the open temperature increased by 30° C. or 40° C. from 170° C. after 1,000 or 2,000 times of snap-action. In a switching device with the arc shield 9 in place, the temperature deviation increased slightly by 5° or 6° C. even after 10,000 operations.

The arc shield 9 serves to protect the bimetallic member 6 from exposure to the radiant heat of the arc generated between the contacts 10 and 12. Therefore, a gradual variation of the open and close temperature by arc heat is avoided, and in addition the durability of the switch becomes long.

In another experiment, for a switching device having open-temperature of 120° C. and close-temperature of 80° C., for a non-arc-shielded device, the temperature deviation was 6° C. or 9° C. after 1,000 or 2,000 times of the snap-action. Under the same condition for the present invention of the arc shielded device the deviation was around 3° C. or 5° C. even after 10,000 times.

It is clear that the temperature deviation rate of the device for high open-temperature is larger than that of the device for low open-temperature. The reason is that the arc generated at the moment of the removal of the movable contact 10 for the fixed contact 12 is induced not only around the fixed contact side including the supporting member 22 and the movable contact 10 but also around the arc shield 9 and the bimetallic member 6 which maintains the same potential as that of the movable contact 10. Heating from the arc which is induced into members causes the snap-action temperature to deviate, or the open-temperature and close-temperature of the bimetallic member 6 to change. Arc is more induced in several times into the high snap-action-temperature device than the low snap-action-temperature device. The arc shield extremely reduces the probability of arcing and minimizes almost all damages by the arc.

Figure 3:
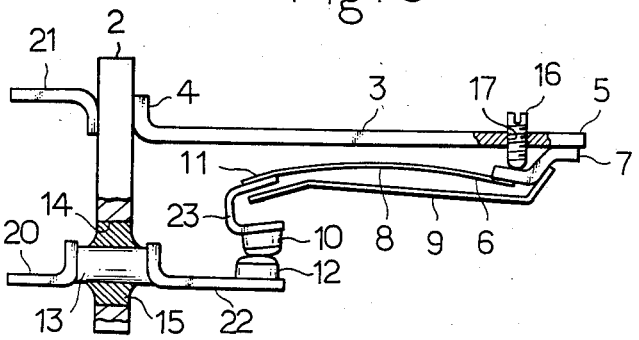
FIG 3. is a sectional view of another embodiment of the present invention.

In another embodiment illustrated in FIG. 3, the movable contact 10 is secured on the U-shaped supporting member 23. The supporting member is fixed at the free end 11 of the bimetallic member 6 which extends from a secured point on the bracket 7. The arc shield 9 is secured on the center of the bracket 7 at its one end 24 and the other end, or the free end of the arc shield 9 extends into the U-shaped supporting member 23 as a partition between the contact 10 and the bimetallic member 6. The arc shield 9 is allowed to be secured on a preferable portion on any member.

In this embodiment, since the arc shield 9 is independent from the snap-action of the bimetallic member 6, it is easy to provide the heat resistant characteristic with the use of a large mass member, electrical insulation material such as ceramics and inorganic substance coated members. The electrical insulation member very effectively protects the bimetallic member 6 from arcing; there is no fear generating of arc between the fixed contact 12 and the arc shield 9. Furthermore, the U-shaped supporting member 23 keeps the contact 10 and 12 apart from the bimetallic member 6 to greatly reduce the influence of the arc on the member 6.

Figures indicated in FIG. 3 which are the same as in FIG. 1 are equivalent. In addition other explanation of the operation of this embodiment is omitted because it will be easily understood in referring to FIG. 1.

Figure 4:
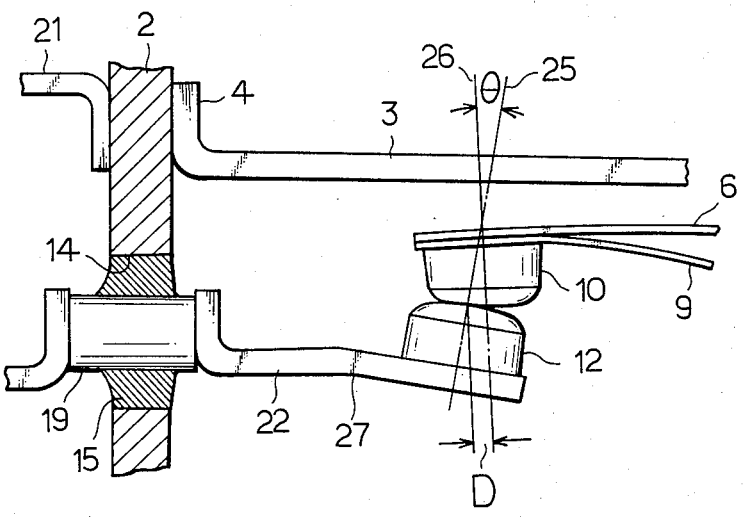
FIG. 4 is, for explanation of a further embodiment of the present invention, a detailed partial equivalent of the sectional view of FIG. 1.

A further embodiment of the present invention is illustrated in FIG. 4, in relation to the improvement of the contacting condition between the fixed contact 12 and the movable contact 10. These contacts are so arranged that the center line 25 of the fixed contact 12 deviates by a distance "D" that is within 15% to 35% of the diameter of the contact from the center line 26 of the movable contact 10 with an inclining angle of "$\theta$"; the fixed contact 12 can be slightly shifted toward the opposite direction of the bimetallic member 6. The relative inclining angle "$\theta$", from our experiment, is preferably between 5° and 30°. The angle "$\theta$" can easily be adjusted by bending the supporting member 22 around the center 27 22.

Such arrangement in relation to the contacts can minimize the generating of arc between the contacts and in addition can get an advantage of keeping the bimetallic member 6 away from the arc, which contributes to a greater reduction of the thermal influence on the bimetallic member 6 from arc than that of the device shown in FIG. 1. Even only the set of the distance "D" can get the effectiveness of the arc reduction by some degree.

Figure 5:
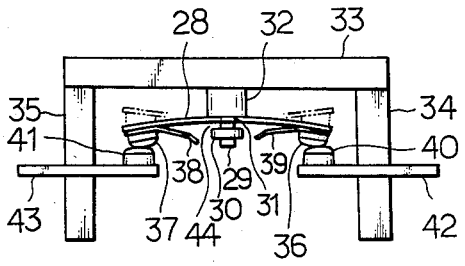
FIG. 5 is a sectional view of an additional embodiment of the present invention.
Figure 6:
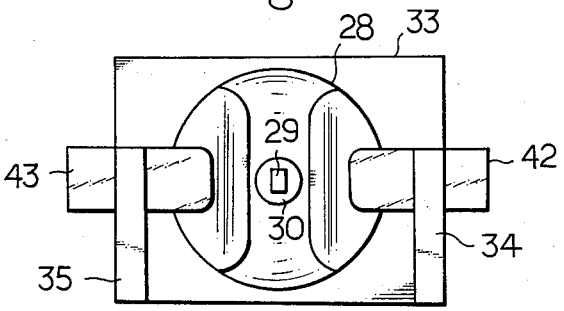
FIG. 6 is a bottom view of FIG. 5.

A further embodiment of the present invention is shown in FIGS. 5 and 6 comprises a nearly-circular bimetallic member 28 supported by means of a small shaft 29 engaged with a stopper 30 through a small hole 31 in the center of a thin dish on the bimetallic member 28. The small shaft 29 is elongated from a supporting member 32 secured on a frame 33 made of an electrical insulating material comprising a housing together with columns 34 and 35.

Two movable contact 36 and 37 are respectively secured together with arc shields 38 and 39 on the bimetallic member 28 synmetrically relative to its center. Fixed contacts 40 and 41 corresponding to the above movable contacts are secured on one end of the supporting members 42 and 43 respectively which serve to lead electricity from the other ends. The supporting members 42 and 43 are fixed in the columns 34 and 35 respectively.

The bimetallic member 28 is so guided that an adequate contact operating condition is kept between the two pairs of the movable contacts and the fixed contacts in response to the snap-action of the bimetallic member 28: there is no deviation from the adequate contact point. Furthermore the bimetallic member 28 must be engaged with the small shaft 29 so as not to be turned. For this purpose the following idea should be presented: a rectangular small shaft 29 is engaged into the corresponding rectangular small hole, or some projections inserted into the bimetallic member along its diameter are engaged with the corresponding recess on the frame 33 (not shown in figures).

A proper clearance 44 between the end of the supporting member 32 and the stopper 30 is necessary for the snap-action of the bimetallic member 28. The stopper 30 is provided for the purpose of stopping the falling of the bimetallic member in the OFF condition shown as the dotted line in FIG. 5.

When an excessive current flows between the terminals 42 and 43, the bimetallic member 28 will be snapped into the opposite concave form, moving the movable contacts 36 and 37 from the fixed contacts 40 and 41 respectively.

In the thermally actuated switching device shown in FIGS. 5 and 6, the bimetallic member 28 is also protected from arc by the arc shields 38 and 39 based on the principle described in the explanation of the embodiment of FIG. 1.

It is possible that the construction of the U-shaped supporting member 23 and arc shield 9 in FIG. 3, and the relative placement and inclining of the contacts in FIg. 4 are applicable to the switching device shown in FIG. 5.

Various changes and modifications of the illustrated embodiment can be made without departing from the scope of the present invention as set forth in the appended claims.

What is claimed is:

1. A thermally actuated switching device comprising:

(a) a thermally actuated member having a fixed end, a free end and an intermediate central dish-shaped portion to induce snap movement, the fixed end being supported by a stationary member;

(b) a movable contact secured to the free end of said thermally actuated member in making and breaking relationship with a fixed contact at selected temperature, an arc being generated upon breaking contact between the movable and fixed contacts; and (c) an arc shield made of a heat-resistant material, one end of the arc shield being cantileverly secured to the free end of the thermally actuated member adjacent to the movable contact, said arc shield extending when said member snaps and snaps back, the arc shield being positioned and adapted so as to shield the dish-shaped portion from the said arc.

2. A thermally actuated switching device set forth in claim 1, wherein said fixed contact is so disposed that its center is deviated from the center of said movable contact by approximately 15% to 35% of the diameter of the fixed contact in the direction away from the center of said thermally actuated member when in the closed condition.

3. A thermally actuated switching device set forth in claim 1, wherein said fixed and movable contacts have a relationship that the center line of each cross and define an inclining angle within a range of 5° to 30° when in the closed condition.

4. A thermally actuated switching device set for the in claim 1, wherein the movable contact moves to its open position at more than 120° C.

5. A thermally actuated switching device comprising:

a thermally actuated member which has a thin dish formed portion which is capable of a snap-action by heat, the said member being supported at one end by a stationary member, a movable contact secured at the other free end of said thermally actuated member through a substantially U-shaped member, the U-shaped member being of electrical conducting material and defining a groove therein, a fixed contact secured on a supporting member in position to be contacted by the movable contact, an arc shield made of a heat-resistant material and so placed that the arc shield separates the space between the thermally actuated member and the pair of movable and fixed contacts in order to shield the thermally actuated member from the radiation of an arc generated between the movable contact and the fixed contact, the arc shield being formed as a plate having a fixed end and a movable end, the movable end being movable within the groove defined in the U-shaped member.

* * * * *